US011510836B2

(12) United States Patent
Cole et al.

(10) Patent No.: US 11,510,836 B2
(45) Date of Patent: Nov. 29, 2022

(54) PAD ASSEMBLY, SYSTEM, METHOD OF PRE-LOAD POSITIONING OF PATIENT FOR MEDICAL PROCEDURE AND KIT

(71) Applicant: Innovative Medical Products, Inc., Plainville, CT (US)

(72) Inventors: Earl Cole, Prospect, CT (US); Tim Blackwell, Jupiter, FL (US)

(73) Assignee: Innovative Medical Products, Inc., Plainville, CT (US)

( * ) Notice: Subject to any disclaimer, the term of this patent is extended or adjusted under 35 U.S.C. 154(b) by 1374 days.

(21) Appl. No.: 15/050,290

(22) Filed: Feb. 22, 2016

(65) Prior Publication Data

US 2017/0239118 A1 Aug. 24, 2017

(51) Int. Cl.
*A61G 13/12* (2006.01)
*A61F 5/37* (2006.01)
(Continued)

(52) U.S. Cl.
CPC ..... *A61G 13/12* (2013.01); *A61G 13/04* (2013.01); *A61G 13/101* (2013.01);
(Continued)

(58) Field of Classification Search
CPC .... A61G 13/14; A61G 13/123; A61G 13/125; A61G 13/1235; A61G 13/124;
(Continued)

(56) References Cited

U.S. PATENT DOCUMENTS 4,725,270 A * 2/1988 Schuldt ..... A61G 13/102 128/849
5,088,137 A * 2/1992 Rose ..... A61G 1/04 128/870
(Continued)

FOREIGN PATENT DOCUMENTS

WO WO2013106426 7/2013

OTHER PUBLICATIONS

Innovative Medical Products, Inc., Humbles LapWrap Positioning Pad, Brochure, Aug. 2014, p. 1, Plainville, CT.
(Continued)

*Primary Examiner* — Camtu T Nguyen
(74) *Attorney, Agent, or Firm* — Damian Wasserbauer, Esq.; Wasserbauer Law LLC

(57) ABSTRACT

A pad assembly, system and method of securing a patient onto an operating table when the patient is in the Trendelenburg position. The pad assembly and system is used to support and hold a patient on a medical procedure table during a medical procedure performed while the table, and thus the patient lying thereon, is in an inclined position, such as the Trendelenburg position. The pad assembly and system has characteristics which promote improved securing to eliminate shifting and/or sliding due to gravitational forces when the patient's body is in the Trendelenburg position, as well as promote a secure holding of the patient in a desired position on the table, in order to minimize injury to the patient. The pad assembly and system further has improved channels to allow for drainage of fluids that may otherwise
(Continued)

be trapped between the patient's body and the OR Table during the surgical procedure.

10 Claims, 11 Drawing Sheets

(51) Int. Cl.

| | |
|---|---|
| ***A61G 13/04*** | (2006.01) |
| ***A61G 13/10*** | (2006.01) |
| *A61G 7/005* | (2006.01) |
| *A61G 13/08* | (2006.01) |
| *A61G 7/057* | (2006.01) |

(52) U.S. Cl.
CPC ..... *A61G 13/102* (2013.01); *A61G 13/121* (2013.01); *A61G 13/125* (2013.01); *A61G 13/127* (2013.01); *A61G 13/1235* (2013.01); *A61G 13/1245* (2013.01); *A61G 13/1295* (2013.01); *A61G 7/005* (2013.01); *A61G 7/05738* (2013.01); *A61G 13/08* (2013.01)

(58) Field of Classification Search
CPC .. A61G 13/127; A61G 7/1023; A61G 7/1026; A61G 7/1051; A61G 7/10; A61G 13/04; A47C 27/146; A47C 27/085; A61F 5/3769; A61F 5/3761
See application file for complete search history.

(56) References Cited

U.S. PATENT DOCUMENTS

| | | | | |
|---|---|---|---|---|
| 8,464,720 | B1 | 6/2013 | Pigazzi | |
| 8,511,314 | B2 | 8/2013 | Pigazzi et al. | |
| 8,539,621 | B2 | 9/2013 | West | |
| 9,161,876 | B2 | 10/2015 | Pigazzi et al. | |
| 10,842,574 | B2 | 11/2020 | Kaforey | |
| 2011/0296609 | A1* | 12/2011 | Giap ..... | A61G 7/1092 5/88.1 |
| 2013/0174853 | A1 | 7/2013 | Pigazzi et al. | |
| 2014/0352072 | A1* | 12/2014 | Holladay ..... | A61G 13/122 5/655.5 |
| 2015/0181951 | A1 | 7/2015 | Kaforey | |
| 2015/0245970 | A1 | 9/2015 | Pigazzi et al. | |

OTHER PUBLICATIONS

Innovative Medical Products, Inc., Humbles LapWrap Positioning Pad—Instructions For Use, Brochure, Aug. 2014, p. 1-2, Plainville, CT.

Innovative Medical Products, Inc., Humbles LapWrap Positioning Pad—Extensions, Brochure, Aug. 2014, p. 1, Plainville, CT.

* cited by examiner

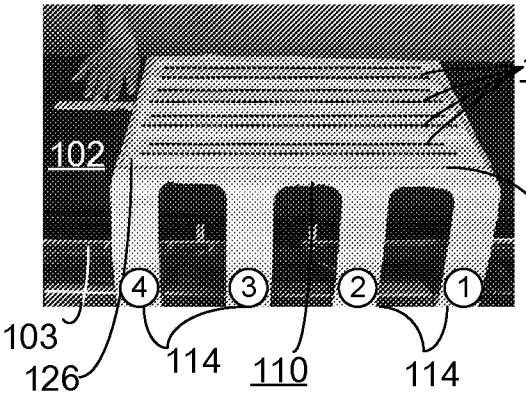
100 FIG. 9A
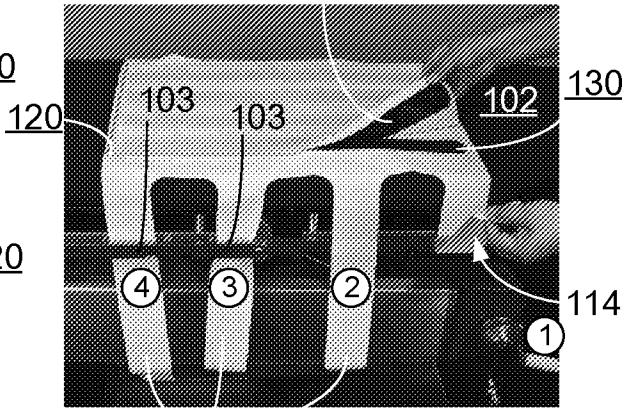
100 FIG. 9B
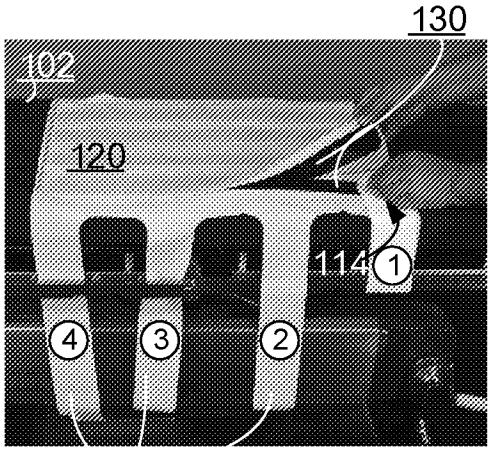
100 FIG. 9C
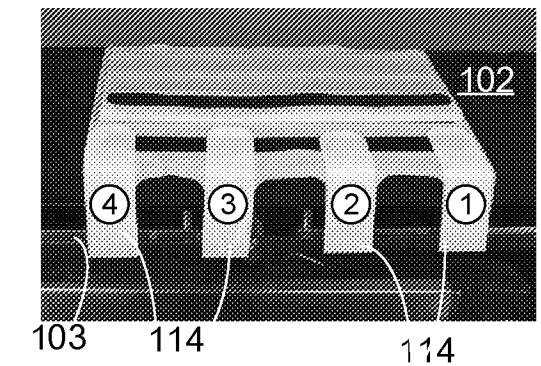
100 FIG. 9D
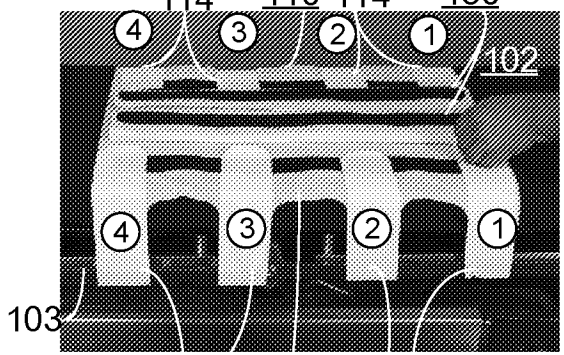
100 FIG. 9E
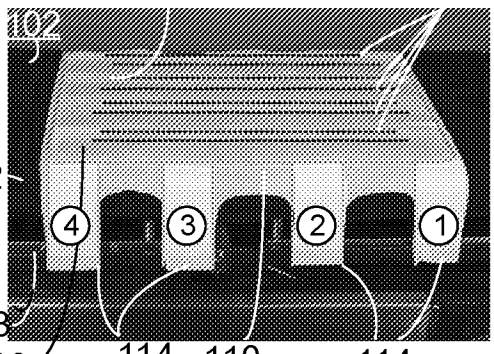
100 FIG. 9F

100

100

100

100

100

PAD ASSEMBLY, SYSTEM, METHOD OF PRE-LOAD POSITIONING OF PATIENT FOR MEDICAL PROCEDURE AND KIT

FIELD OF THE INVENTION

The present invention relates to a pad assembly, system, kit, and method for maintaining a patient's position during a medical procedure on an Operating Room (OR) Table and, more particularly, to an improved pad assembly using anchoring to remove the slack, limb straps to the improve ventilation and prevent nerve damage on the brachial plexus, with an integral gel pad assembly with fluid channeling.

BACKGROUND OF THE INVENTION

Conventional pad systems are useful in positioning a patient for robotic, laparoscopic and other surgical procedures. These positioning pad systems may use straps or restraints across the patient's chest which can obstruct ventilation and breathing. Other conventional positioning systems may be formed with straps positioned about the entire patient arm (i.e. without chest straps) to permit unobstructed ventilation and breathing. Conventional positioning systems may be formed with a visco-elastic pad (e.g. commonly referred to as "memory foam") so as to minimize pressure forces on the patient's body by the cushioning of the visco-elastic pad so as to minimize injury when the straps are secured to the operating room table. However, the visco-elastic pad construction has disadvantages in restricting access for intravenous (IV) lines during a medical procedure. Moreover, the visco-elastic pad construction has disadvantages when the medical procedure requires irrigation because visco-elastic material absorbs fluids that are presented against the skin during a medical procedure and many medical procedures last for hours including Trendelenburg positions. The retention of fluids against the skin of the patient for long periods of time has disadvantages as this may cause ulcers and other adverse impacts to the patient health.

The visco-elastic pad construction has disadvantages of slipping when placing the patient in the Trendelenburg position, e.g. the body of the patient shifting or sliding especially when the patient is inverted in Trendelenburg position on an OR Table. Repositioning the visco-elastic pad and patient is time consuming and awkward during a medical procedure. Still yet Another disadvantage is that certain procedures may use reverse Trendelenburg position—either alone or in combination with a Trendelenburg position—on an operating room table whereby conventional pads are not capable of both and requiring re-positioning and re-securing, and sometimes a new pad, with the additional operating room time and cost.

Anatomically, conventional pads also have disadvantages as their design may cause restrictions to the shoulders, neck or head to impinge the brachial plexus nerves thereby impairing their function of the brachial plexus nerve network (e.g. the lateral medial and posterior nerve cords running from the spine to the shoulder) causing post-surgery health problems for the patient.

As a result there is a need for an improved pad that can position and hold a patient for a medical procedure. There is also a need to provide a positioning pad that can secure and maintain a patient in a position using a unique pre-load safety feature that "anchors" the patient on and/or to the OR Table. There is also a need to improve the securing and maintaining the patient in a position prior to positioning in Trendelenburg. There is also a need for a positioning pad for securing and maintaining the patient for a Trendelenburg and reverse Trendelenburg positioning. There is a long-felt need to improve minor repositioning adjustments to the pad and the patient.

SUMMARY OF THE INVENTION

It is an object of the present invention to provide an apparatus, system and method to secure and maintain a patient in a position using a unique pre-load safety feature that "anchors" the patient on an OR Table.

It is an object of the present invention to provide an apparatus, system and method for securing and maintaining the patient in a position prior to positioning in Trendelenburg and an improved positioning pad for securing and maintaining the patient position and any minor repositioning adjustments.

It is an object of the present invention to provide an apparatus, system and method to improved positioning pad for securing and maintaining the patient for a Trendelenburg and reverse Trendelenburg position and any minor repositioning adjustments.

It is an object of the present invention to provide an apparatus, system and method to eliminate restriction to the shoulders, neck or head that may cause injury from a potential impingement to the brachial plexus.

It is an object of the present invention to provide an apparatus, system and method that overcomes the disadvantages of the prior art and that advantageously can be configured to be positioned taut and configured with straps that can be repositioned easily during a surgical procedure.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Description of the Embodiments, which is to be read in association with the accompanying drawings, which are incorporated in and constitute a part of this specification, show certain aspects of the subject matter disclosed herein and, together with the description, help explain some of the principles associated with the disclosed implementations, wherein:

FIGS. 9A to 9F illustrate steps of an embodiment of the preload positioning pad apparatus, system and method of anchoring a patient according to an embodiment of the present invention;

FIGS. 11A to 1F illustrate steps of securing the limb straps of a pad assembly in a method according to an embodiment of the present invention;

DESCRIPTION OF THE EMBODIMENTS

Figure 1:
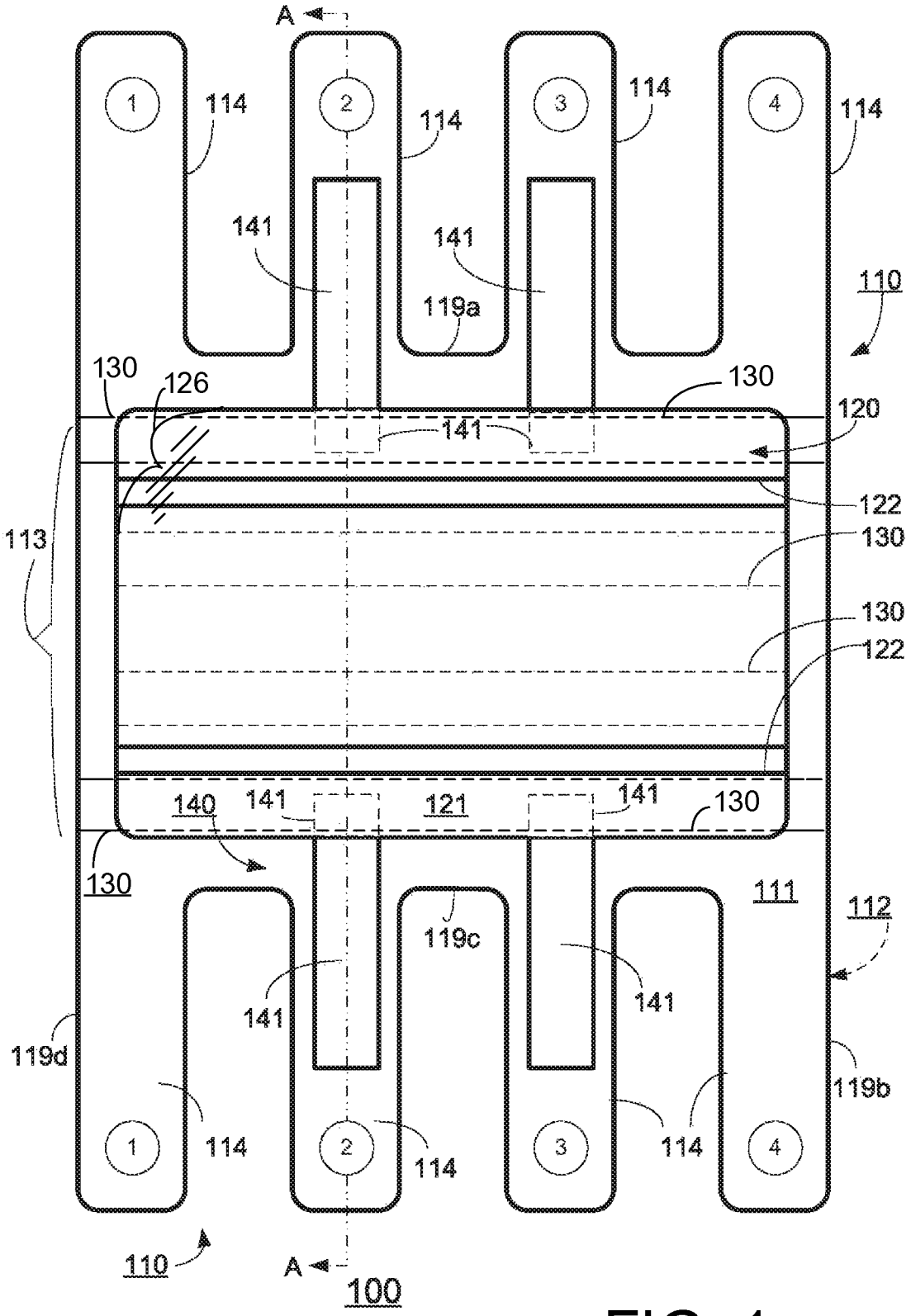
FIG. 1 illustrates a schematic top view of the preload positioning pad apparatus, system, kit and method in accordance with an embodiment of the present invention.

Non-limiting embodiments of the present invention will be described below with reference to the accompanying drawings, wherein like reference numerals represent like elements throughout. While the invention has been described in detail with respect to the preferred embodiments thereof, it will be appreciated that upon reading and understanding of the foregoing, certain variations to the preferred embodiments will become apparent, which variations are nonetheless within the spirit and scope of the invention.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "some embodiments", "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are provided for the purposes of illustrating some embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

The term "body" refers to a physical structure of a human being (or animal) comprising a torso with a right side, a left side, front side, back side and not including the head, limbs such as arms, legs and thighs. The term "limb" refers to a physical structure of a human being (or animal) comprising arms, legs and thighs.

The term "surgical operation" or "medical procedure" means a medical procedure on a patient or human being. In some surgical operations, a patient may be placed on a support or OR Table which is oriented horizontally and otherwise perpendicular respect to the vertical orientation. However, depending on the medical procedure, it may be more advantageous to orient the patient at an incline with respect to the horizontal by tilting the support or OR Table. The term "orient the patient at an incline" refers to orienting the patient relative to the plane of the OR Table such as, for example, the body of the patient may tilted at an angle with respect to horizontal such that the head of the patient is disposed lower than the body (e.g. Trendelenburg position); the head of the patient is disposed higher than the body (e.g. reverse Trendelenburg position); the right side of the patient is disposed higher than the left side of the patient; the left side of the patient is disposed higher than the right side of the patient; or a combination of any of the foregoing.

The term "Trendelenburg", "Trendelenburg position" or "reverse Trendelenburg position" means to orient the support or operating table, and thus the patient, at an incline with respect to the horizontal. For medical procedures relating to the lower body, such as, for example, abdominal or gynecological operations, the Trendelenburg position involves a patient first lying horizontally on the support table, operating table or a portion thereof, with the table then inclined such that the head and upper torso of the patient is at a vertically lower position than the pelvic region and/or legs of the patient is elevated relative thereto so as to utilize gravity to draw the inner organs away from the pelvic region and/or legs to facilitate the operation in such region. In general, the support table is inclined such that the patient's head and upper torso is lowered from the horizontal anywhere in a range of approximately five, ten, or fifteen degrees to approximately twenty, thirty, or forty-five degrees or more, in a steep Trendelenburg position, in one degree increments or fractions of one degree increments. For medical procedures relating to the upper body, such as, for example, neck operations, the "reverse Trendelenburg position" may be used, whereby the head and upper torso is elevated (i.e. at a vertically higher position) relative to the than the pelvic region and/or legs of the patient. As used herein, the phrase Trendelenburg position should be understood as referring to both positions, however, the advantages of the pre-loading clamping may refer to each in ways to accomplish the pre-loading feature so as to eliminate slack and patient slippage.

The term "hook" "hook fabric" or "loop" "loop fabric" means a hook and/or loop material such as VELCRO® brand fabric and fastening device and/or system as originally described in U.S. Pat. No. 3,009,235 A and currently manufactured by Velcro Industries B.V. The term "loop fabric" may be integrated into one or more surfaces of a plastic substrate for example, the loop fabric may be formed on an outward face of the substrate to interconnect operably with hook fabric on another substrate of hook fabric portion. Moreover, a plastic substrate may have loop fabric on both outward face surfaces, for example, top and bottom, whereby the outward face of the loop fabric on the substrate may interconnect operably with hook fabric on another substrate or be disposed between two hook fabric surfaces to hold the double-sided loop fabric therebetween. The term "hook fabric" may be integrated into one or more surfaces of a plastic substrate for example, the hook fabric may be formed on an outward face of the substrate to interconnect operably with loop fabric on another substrate of loop fabric portion.

Figure 12A:
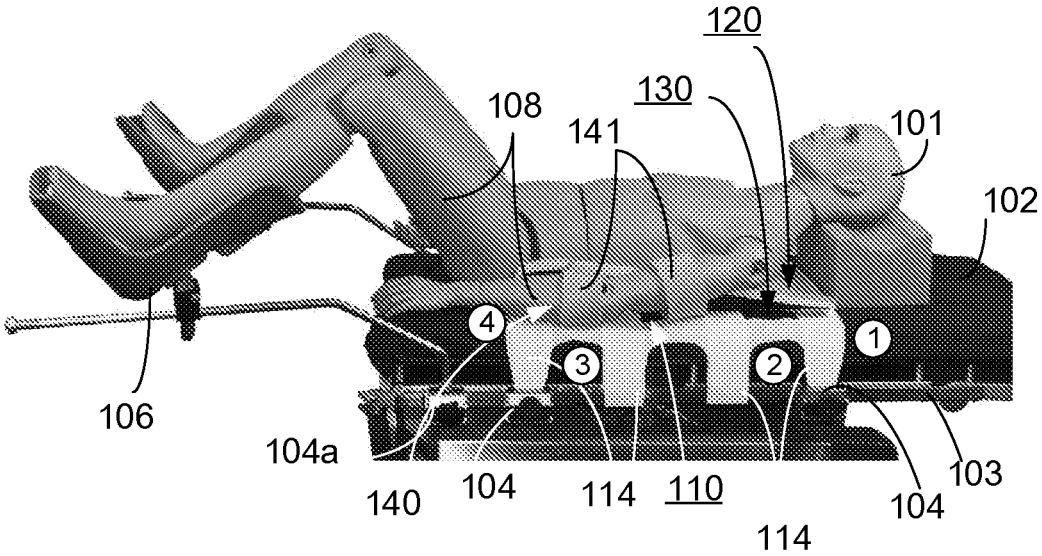
FIGS. 12A to 12B illustrate a patient anchored by the steps of a method utilizing a preload positioning pad assembly, system and kit according to an embodiment of the present invention.
Figure 12B:
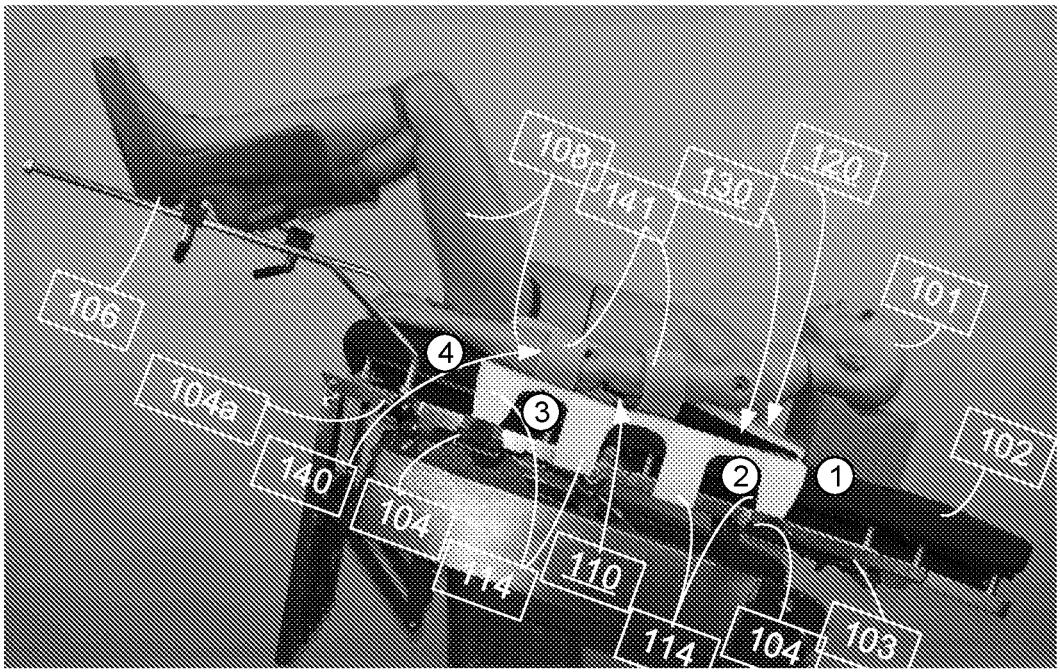

The term "pre-load" or "pre-loading" means to tighten, make taut, and/or remove the slack from the straps 114 so as to eliminate the stretch of the fabric, the movement of the patient 101 and/or to otherwise secure the patient 101 to the support or operating room (OR) Table 102. Accordingly, the pre-load function of the positioning pad assembly and kit 100 of the present invention advantageously removes slack that has been observed to exist and present safety problems with heavy and/or large patients 101, with some positions the patient 101 is placed in for certain medical procedures 105 and other factors. The method, apparatus, system and kit 100 is infinitely variable and may be utilized any type of patient in the intended medical procedure 105 including knee surgery that may require securing a limb to a boot 106 as shown in FIGS. 12A and 12B.

As is illustrated in FIGS. 1-16, a pre-load positioning pad apparatus, system, kit and method of anchoring a patient, is generally designated as element 100. The pre-load positioning pad assembly or apparatus and system is described in detail in FIGS. 1-4, and 13-15. A sterilized kit 150 comprising a pre-load positioning pad assembly and system 110, 120, 130, 140 and clamps 104 is generally described in FIGS. 5-6. It should be appreciated that the method 100 to secure and maintain the patient 101 in a desired position as illustrated in FIGS. 9A through 12B. The a medical procedure is described in, in an embodiment for Trendelenburg position on a support or operating room (OR) table 102 with side rails 103 configured to receive clamps 104 so as to secure the patient 101 safely in such predetermined orientation, e.g. FIGS. 7-8 and 12A-12B. The pre-load positioning pad assembly 100 eliminates sliding, shifting, or similar undesirable movements of the patient 101 on the OR Table 102, which movements could be disruptive to a medical procedure 105 being performed on the patient 101.

Figure 2:
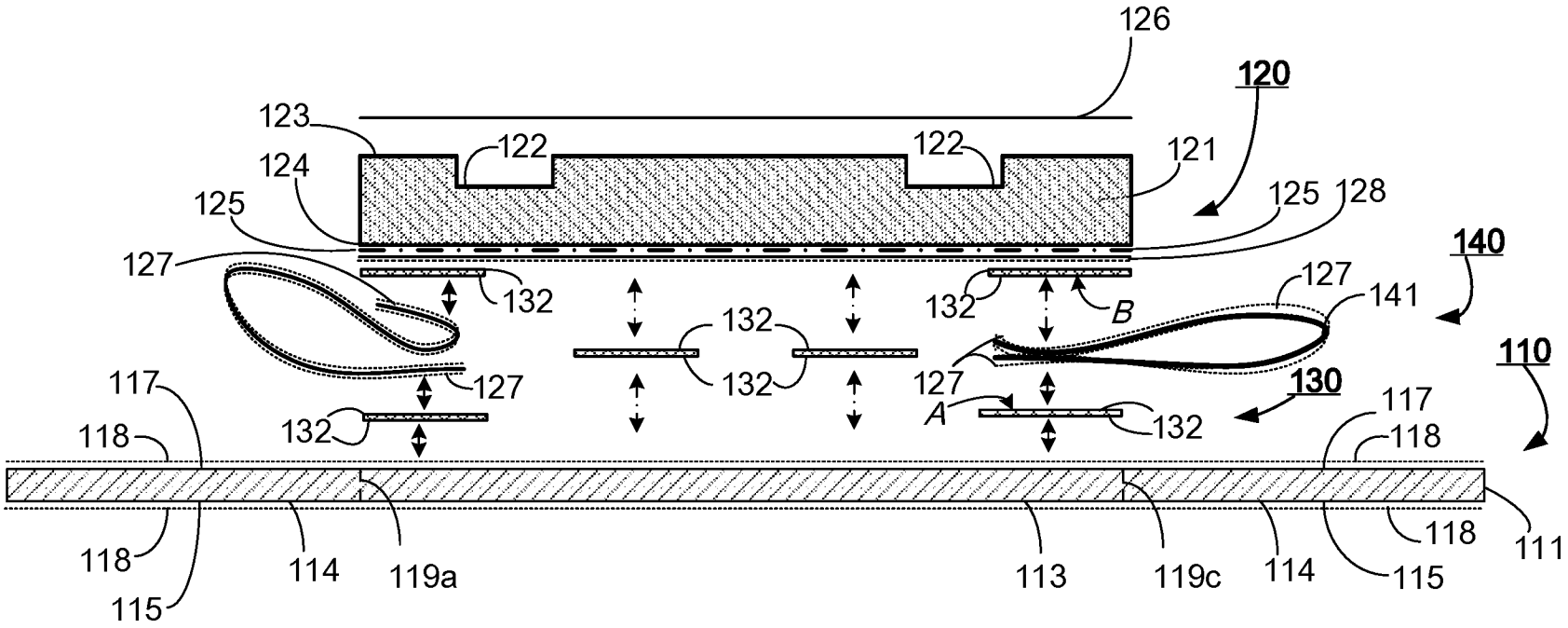
FIG. 2 illustrates a schematic side cross-sectional view taken along lines A-A of FIG. 1 of the preload positioning pad assembly, apparatus, and system.

Referring to FIGS. 1-4, the pre-load positioning pad 100 may be disassembled into the pad assembly 110, gel pad assembly 120, hook fabric and/or hook tape 130 and retaining assembly 140 for attaching to the patient 101 as such features and assembly is shown in FIGS. 1-15. As illustrated in FIGS. 1 and 2, the pad assembly 110 comprises a base 111 that may be formed in a predetermined design 112 with a central or center portion 113 and a plurality of pre-load straps 114, preferably four (4), extending therefrom and adapted to be received by clamps 104. Various clamps 104 may be utilized, and a TrenMax clamp 160 discussed herein is available under the mark TrenMax™ and from Innovative Medical Products, Inc., Plainville, Conn. The base 111 of the pad assembly 110 may be formed from plastics, medical grade thermo-plastics, adhesive gels, and medical grade polymer composite adhesive gels that are not silicon based having (1) suitable strength, (2) an abrasive structure for clamping and (3) a polymer web structure that resists stretching. The base 111 may be formed with one or more surfaces of loop and/or loop fabric 118 to form a loop fastener to operably connect to hook fastener of double sided 131 hook fastener of hook tape 130, single-sided hook fastener 132 of hook fabric.

Figure 14:
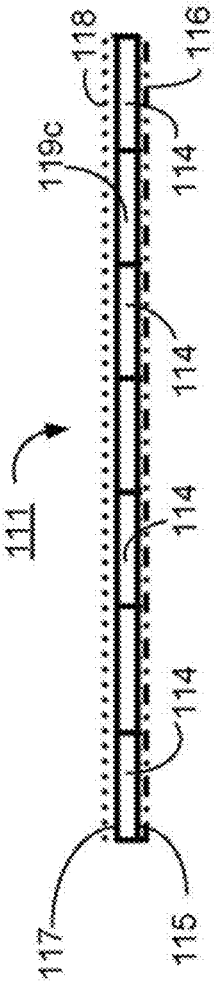
FIG. 14 illustrates a side view of a preload positioning pad assembly, system and kit according to another embodiment of the present invention.
Figure 15:
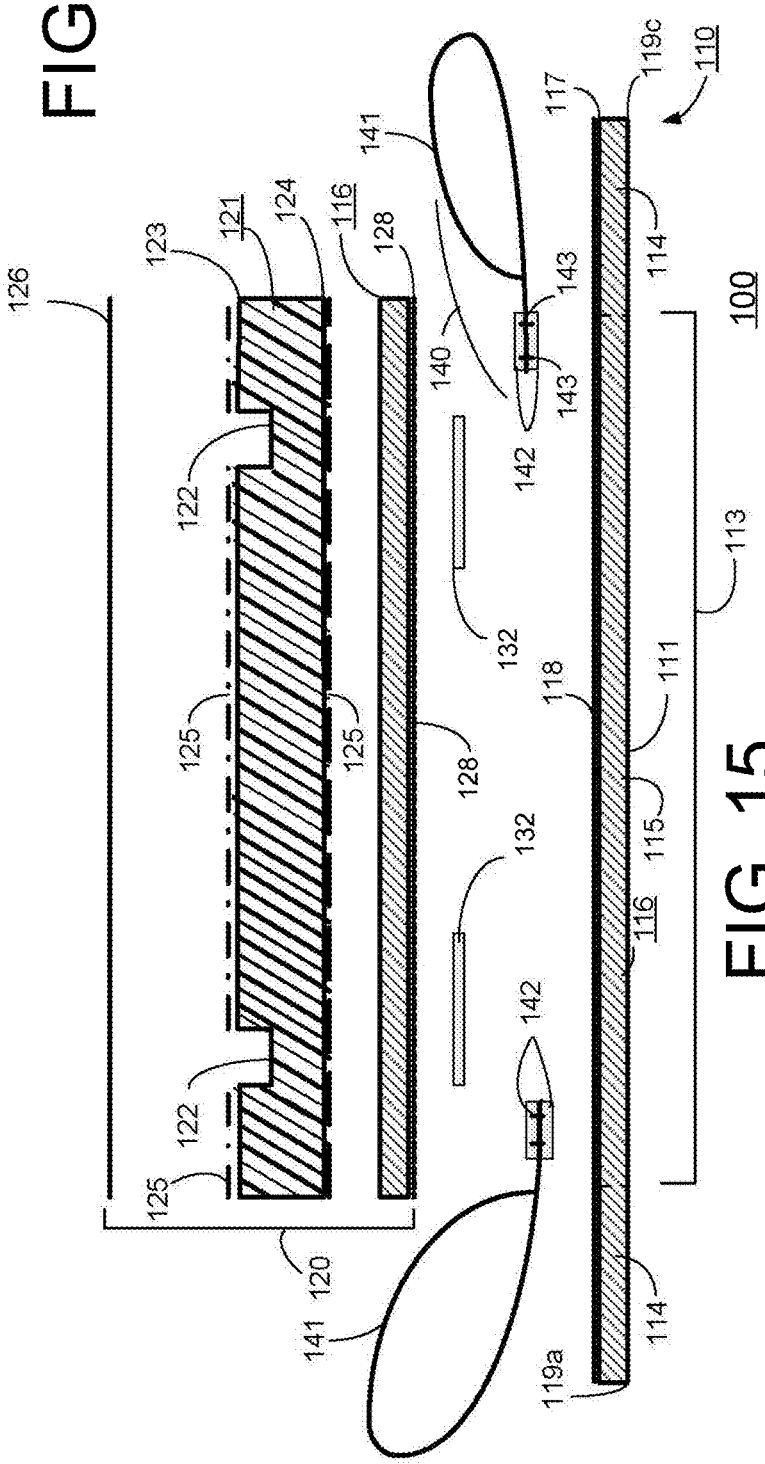
FIG. 15 illustrates a side cross-sectional view of a preload positioning pad assembly, system and kit, taken along a similar line A-A for a different construction of the pad according to yet assembly embodiment of the present invention.

A base 111 may be formed from a suitable plastic infused with loop fabric manufactured by Velcro Industries B.V. and available by IMP part number 613-904. Advantageously, The base 111 may be formed with a bottom surface 115 and top surface 117 formed of loop material 118 generally fused into the upper surface of the thermoplastic that functions to secure hook material thereto as shown in FIG. 2. In an alternative embodiment as is illustrated in FIGS. 14 and 15, the base 111 has a top surface 117 formed of loop material 118 generally fused into the upper surface of the thermoplastic that functions to secure hook material thereto and the bottom layer 115 is formed with a smooth surface 116 as discussed herein.

Figure 3:
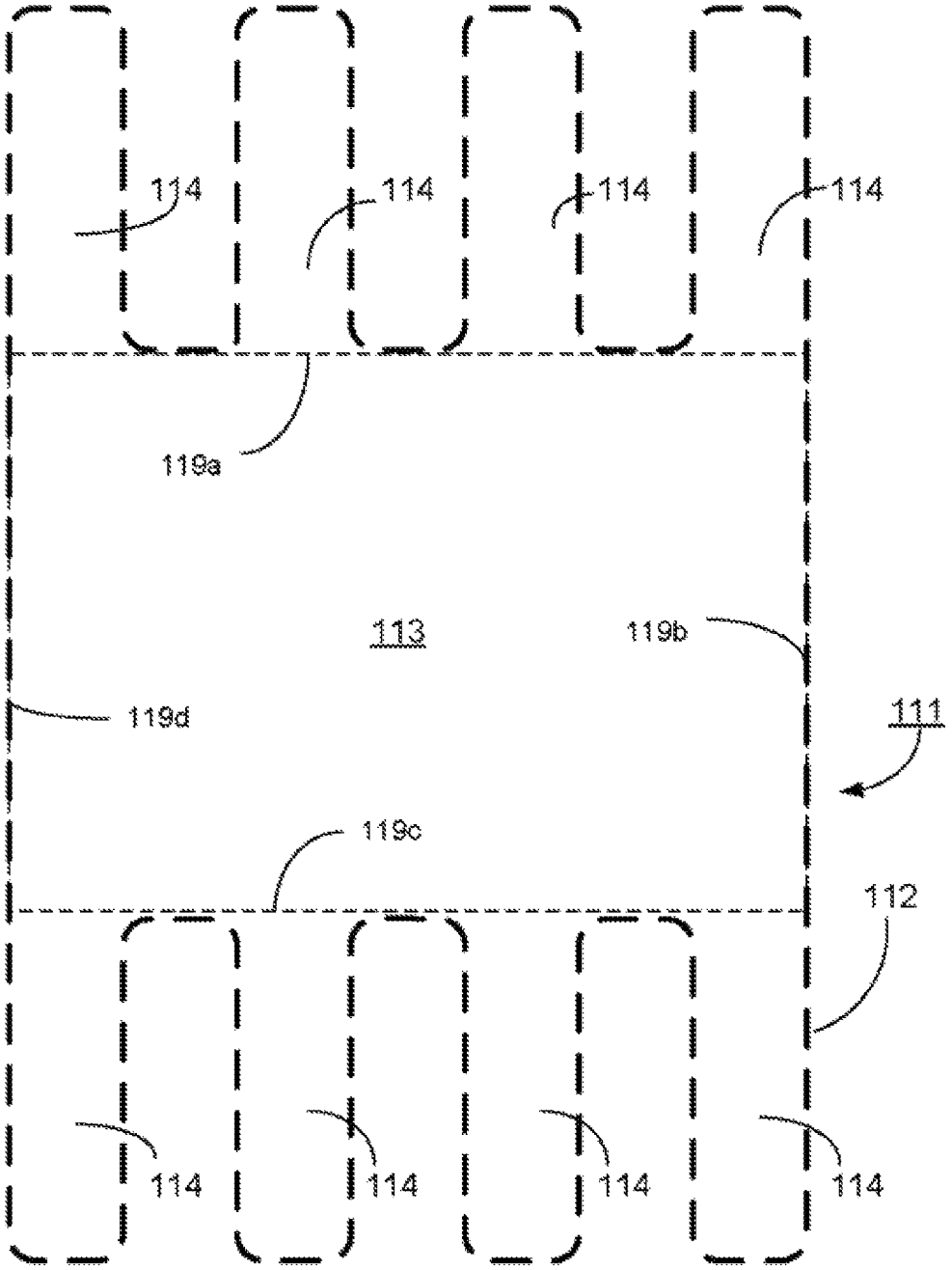
FIG. 3 illustrates a schematic top view of a pre-determined design for preload straps and base pad according to an embodiment of the present invention.
Figure 4:
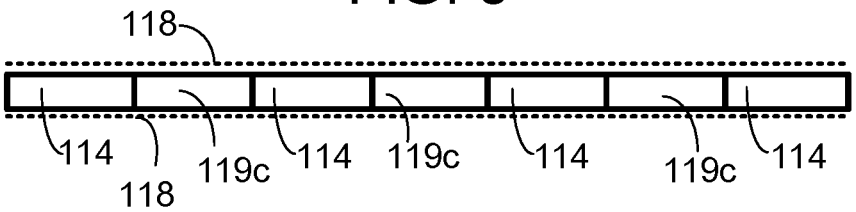
FIG. 4 illustrates a schematic side view of the predetermined design for preload straps and base pad in FIG. 3.

As is illustrated in FIGS. 1, 3 and 4, the pre-load positioning pad 100 comprises a pad assembly 110 having a base 111 of a predetermined design 112. The predetermined design 112 may be formed with a center portion 113 and a plurality of pre-load straps 114. As shown in FIG. 3, the center portion 113 is of a generally rectangular shape having four side edges 119*a*, 119*b*, 119*c* and 119*d*. The plurality of pre-load straps 114 may be formed extending from opposite side edges 119*a* and 119*c* therefrom. The plurality of pre-load straps 114 may be designated straps 1, 2, 3, and 4, e.g. ①,②,③, and ④, respectively, for ease of illustration of the method of anchoring a patient 101 using the pre-load positioning pad 100 according to an embodiment of the present invention as described in FIGS. 9A through 12B. Each of the pre-load straps 114 are adapted to be received in the clamp 104 secured to an OR Table 102 such as, for example, clamped to a side rail 103, as shown in FIGS. 5, 7-8, and 10A-E.

Referring to FIGS. 1, 2, 9A-9F, 10A-10E, 11A-11F, 13 and 15, the pre-load positioning pad 100 further comprises a gel pad assembly 120 having a gel base 121 formed with one or more channels 122 for allowing fluids (e.g. body fluids, sweat, or irrigation water utilized in certain medical procedures 105) to flow out from beneath the patient 101 secured to the OR Table 102 during a medical procedure. The gel base 121 may be formed from suitable materials such as, for example, a sterile non-latex gel with affixing securing properties available from Innovative Medical Products, Inc. Plainville, Conn. under the product name and trademark Phase 4™ Gel. The gel base 121 is configured with an upper surface 123 shielded prior to use by a film 126 so as to protect the surface that has sticky, adhesion properties and from environmental contamination. The film is configured and made removable for peeling away at the time of positioning for the medical procedure as shown in, for example, FIGS. 1 and 11C. The upper surface 123 of the gel pad assembly 120 is adhered to a body surface of the patient 101 (e.g. the chest or back).

Referring to FIG. 2, according to an embodiment of the invention, the gel pad assembly 120 may be configured with loop fabric 128 fused into lower surface 124, or otherwise affixed by adhesive 125 to a lower surface 124, of the gel base 121 so as to function to operably connect the loop fabric 128 to hook tape 130 such as, for example, double-sided hook tape 132. In an alternative construction in the embodiment illustrated in FIG. 13, rows of single-sided hook tape 131 may be affixed by adhesive 125 to a lower surface 124 of the gel base 121 aligned and adjacent to the edges 119*a* and 119*c* of the center portion 113, that are configured to secure to loop material 127 disposed on portions of the assembly 100 such as, for example, limb straps 141 and to secure the gel base 121 to the loop fabric 118 of the base portion 111 of the pad assembly 110 as discussed herein. In yet another construction in the embodiment illustrated in FIGS. 14-15, the gel pad assembly 120 may be configured with plastic material 116 formed with loop fabric 128 affixed by adhesive 125 to a lower surface 124 of the gel base 121. Gel pad assembly 120 functions so as to operably connect the loop fabric 128 to hook tape 130, which may be, for example, double-sided hook tape 132. Gel pad assembly 120 also functions so as to operably connect and hold the loop fabric 128 to a hook surface 142 stitched 143 to end(s) of the plurality of limb straps 141.

As shown in FIGS. 1-4, 9A-9F, 10A-10E, 11A-11F, and 13, the hook fastener 130, which may be employed as double-sided hook tape 132, connects to and holds loop material 127 of the plurality of limb straps 141. Similarly, as shown in FIGS. 9A-9F, 10A-10E, 11A-11F, 14 and 15, the hook fastener 130, which may be employed as double-sided hook tape 132, connects to and holds loop fabric 128 of the gel pad assembly 120, and also connects to and holds loop fabric 118 of the pad assembly 110. Generally, hook fastener 130 is oriented for support (e.g. along a spinal axis of the patient 101) so that the patient 101 remains in the desired position relative to the OR Table 102, when inclined such as in the Trendelenburg position, in the reverse Trendelenburg position, or both, or horizontally on the OR Table 102. It is appreciated that diagonal or other orientations are possible to secure and/or fasten to the loop material 127 on the gel pad assembly 120 and loop fabric 118. Single-sided hook tape 131 and/or double-sided hook tape 132 may be utilized for fastening device and/or system and is available in various forms as manufactured by Velcro Industries B.V.

As shown in FIG. 4, the retaining assembly 140 is comprised of one or more limb strap(s) 141 with loop material 127 fused or otherwise configured with a loop fastener formed in the material. The one or more limb strap(s) 141 are formed of pliable, stretchable material with suitable strength to be secured to a limb of the patient 101 and to hold the patient in Trendelenburg position or inverted without failure of the material. Suitable materials are manufactured by Velcro USA Inc. and available under IMP part number 613-904. The design of the pad apparatus and system 100 utilizing the limb strap(s) 141 allows advantageously access for leads and IV's such as, for example, as access is needed for Anesthesiology in a medical procedure. The pad apparatus and system 100 utilizing the limb strap(s) 141 further advantageously avoids or otherwise prevents potential neurological impairment caused by sheet tucking, e.g. prevent tissue injury and ischemia that may be caused by tucking a patient's arms at his or her side. The pad apparatus and system 100 utilizing the limb strap(s) 141 prevents nerve damage by eliminating pressure on brachial plexus and has additional advantages improving ventilation, thereby avoiding the numerous problems of conventional apparatus and techniques that require the use of a chest strap.

The loop material 127 of the one or more limb strap(s) 141 is configured to operably connect the loop fabric 128 to hook tape 130 such as, for example, double-sided hook tape 132 as is shown in FIGS. 2, 9A-9F, 10A-10E, 11A-11F, and 13. In an alternative construction in the embodiment illustrated in FIGS. 14 and 15, the loop fabric 128 is affixed by adhesive 125 to a lower surface 124 of the gel base 121 so as to operably connect the loop fabric 128 to hook tape 130 such as, for example, double-sided hook tape 132 and to connect and hold a hook surface 142 stitched 143 to end(s) of the plurality of limb straps 141. The pad assembly 110, gel pad assembly 120, hook tape 130 and retaining assembly 140 cooperate in securing and maintaining the patient 101 in a position prior to positioning in Trendelenburg and an improved positioning pad for securing and maintaining the patient position; and any minor repositioning adjustments.

Figure 5:
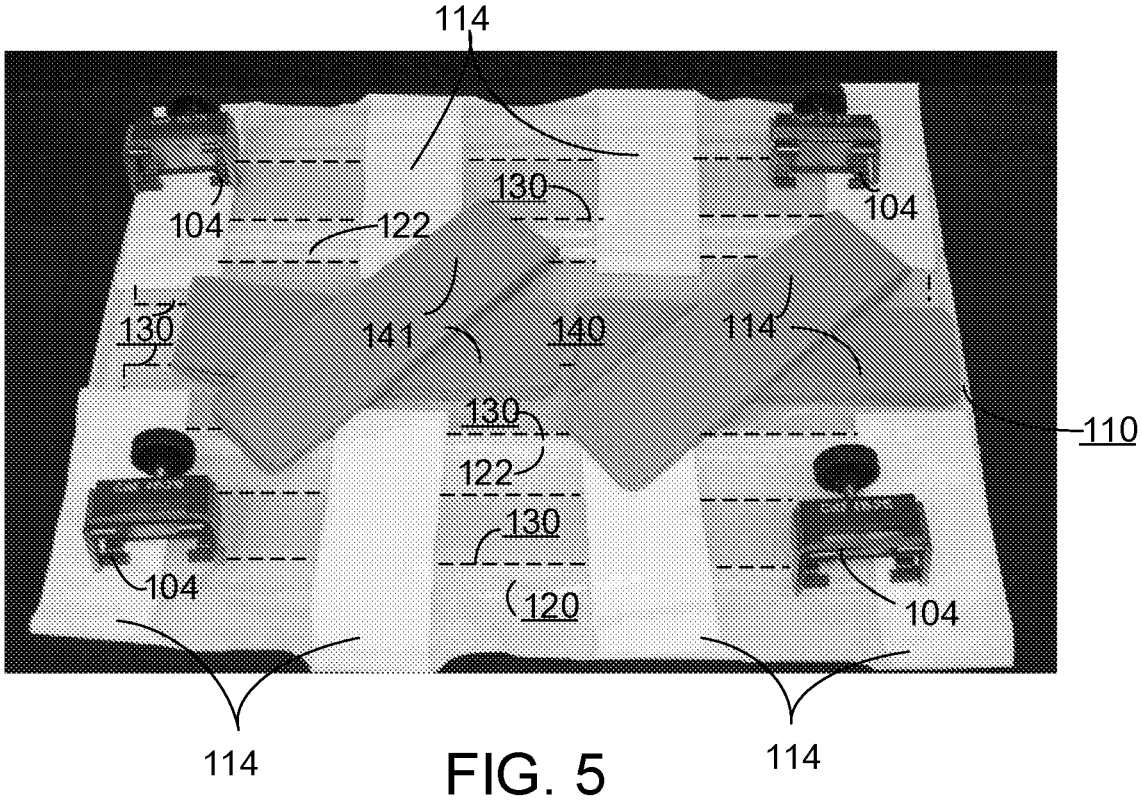
FIG. 5 illustrates a schematic view of a sterile kit with clamps of a preload positioning pad and system useful for performing the anchoring method according to an embodiment of the present invention.
Figure 6:
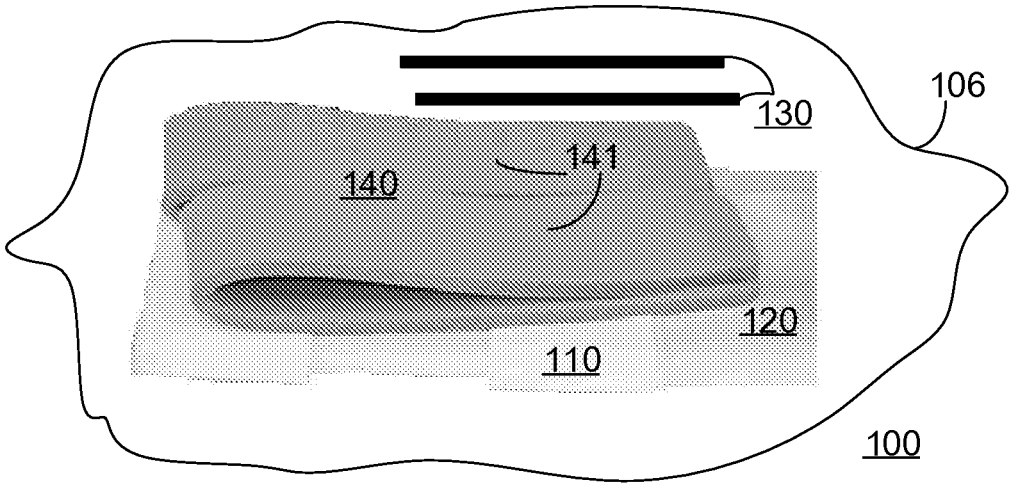
FIG. 6 illustrates a schematic view of a sterile kit of a preload positioning pad apparatus and system according to an embodiment of the present invention.
Figure 16:
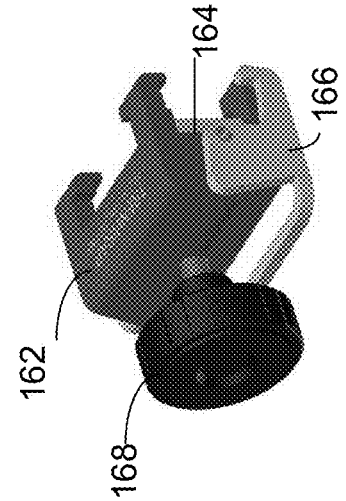
FIG. 16 illustrates a perspective view of a preload clamp utilized in the positioning pad assembly, system, method and kit according to another embodiment of the present invention.

Referring to FIGS. 5 and 6, a sterile preload pad kit 150 has all the elements of the pre-load positioning pad assembly, system, method and kit 100 and clamps 104, sterilized, and packaged in a bag or other container 106 to maintain sterility during transportation, storage and the like. The sterile preload pad kit 150 are packages of the pre-load positioning pad assembly, system, method and kit 100 comprising one or more clamps 104, preferably four (4) clamps as shown in FIG. 16, a pad assembly 110 as described herein with the pre-load straps 114, a gel pad assembly as 120 described herein, one or more strips of the hook tape 130, and the retaining assembly 140 that includes a plurality of limb straps 141, preferably four (4) limb straps. All of the elements of the preload pad kit 150 may be sterilized using standard sterilization techniques and sealed. In this manner, a single-use pad assembly 100 may be formed to be available for a surgical operation that advantageously prevents potential cross-contamination as may be present in conventional systems and techniques.

The operation of the anchoring process of the pre-load positioning pad assembly, system, method and kit 100 is described according to an embodiment of the present invention with reference to FIGS. 9A-9F, 10A-10E, and 11A-11F. Referring to FIGS. 9A-9F, the pre-load pad assembly 100 may be placed on an OR Table 102, with the loop fabric 118 side UP and/or the film 126 side UP. Alternatively, the pre-load positioning pad 100 may be disassembled from the sterile packaging 106 to expose the pad assembly 110, gel pad assembly 120, hook tab and retaining assembly 140 for attaching to the patient 101. Accordingly, the pre-load positioning pad assembly and kit 100 of the present invention advantageously is infinitely variable and may be utilized any type of patient (or for animals) in the intended medical procedure 105.

Figure 7:
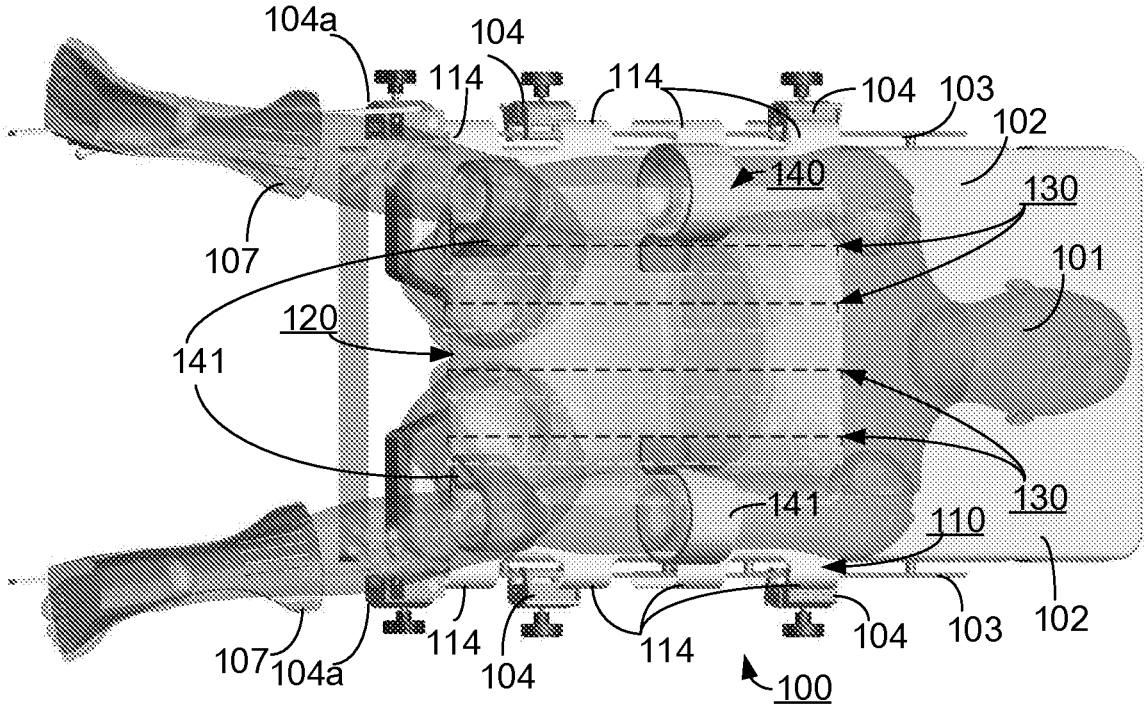
FIG. 7 is a schematic top view illustrating the preload positioning pad with a patient prepared and anchored for a medical procedure according to an embodiment of the preload positioning pad apparatus, system and method.
Figure 8:
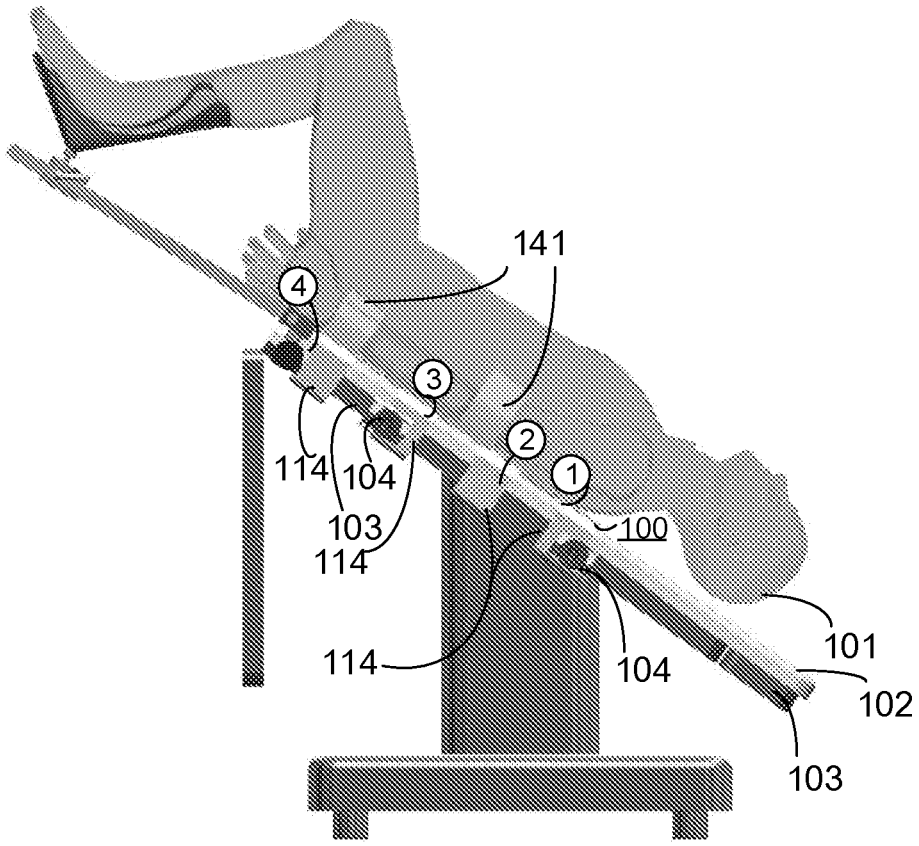
FIG. 8 is a schematic side view illustrating an embodiment of the preload positioning pad apparatus, system and method in Trendelenburg position.

Referring to FIG. 9A, in a Step 1, the pre-load pad assembly 100 may be placed on an OR Table 102 to position a distal edge one (1) handbreadth (or approximately six (6) inches) from the peroneal cutout, thereby allowing the pre-load straps 114 of the pad assembly 110 to drape over each edge of the OR table 102 leaving space on the side rail 103 to attach the stirrups for the boot or other limb holder (FIGS. 7 and 8) with the loop fabric 118 side UP and/or the film 126 side UP. In Step 1, the one or more preload straps 114 are oriented to drape over the end of the OR Table 102 across the side rail 103. Each of the pre-load straps 114 to be engaged are fitted through a clamp 104 secured to the side rail 103 as is illustrated for example in FIGS. 7, 8, and 9A-9F. For unusual table positions, heavier patients, or as needed, patient 101 can be secured to side rail of the OR Table 102 by multiple clamps 104, for example, clamping with clamps 104 all of the available pre-load straps 114 to preload the position, e.g. by eight (8) clamps for the predetermined design 112 shown in FIGS. 1, 3-4, 7-8, 9F, and 10E prior to Trendelenburg positioning. Alternatively, a selective number of the pre-load straps 114 to be engaged are fitted through a clamp 104 secured to the side rail 103 as is illustrated in FIG. 8. For example for a large dimensioned patient the straps 114 near the neck and buttocks are secured to the clamp 104, e.g. straps 1 ① and 4 ④ as shown in FIG. 1. In a smaller dimension person, straps 1 ① and 2 ② and/or straps 1 ① and 3 ③ are used as strap 1 ① is disposed near the patient's neck and straps 2 ② or 3 ③ are disposed at the lower end of the torso near the buttocks. Still further, straps 1 ① and 3 ③ can be preloaded and clamped advantageously taut so the patient 101 does not shift or slip in an orientation for a Trendelenburg position and straps 2 ② and 4 ④ can be preloaded and clamped in an orientation for reverse Trendelenburg position. Moreover, in any configuration of straps 114, the plurality of straps 114 may be repositioned easily along the rail 103 during a surgical procedure 105 as needed. Accordingly, the pre-load positioning pad assembly and kit 100 of the present invention advantageously is infinitely variable and may be utilized any type of patient in the intended medical procedure 105.

Referring to FIGS. 9 and 10, a sterile preload pad kit 150 of the pre-load positioning pad assembly, system, method and kit 100 is described according to another embodiment of the present invention. The sterile preload pad kit 150 comprises one or more clamps 104, preferably four (4) clamps, a pad assembly 110 as described herein with the preload straps 114, a gel pad assembly as 120 described herein, one or more strips of the hook tape 130, and the retaining assembly 140 that includes one or more limb straps 141, preferably four (4) limb straps. All of the elements of the preload pad kit 150 may be sterilized using standard sterilization techniques and sealed. In this manner, a surgical operation advantageously started with all the elements of the pre-load positioning pad assembly, system, method and kit 100. It should be appreciated such an embodiment of the present invention 100 overcomes the disadvantages of the prior art and that advantageously can be configured to be positioned taut and configured with straps that can be repositioned easily during a surgical procedure.

Figure 13:
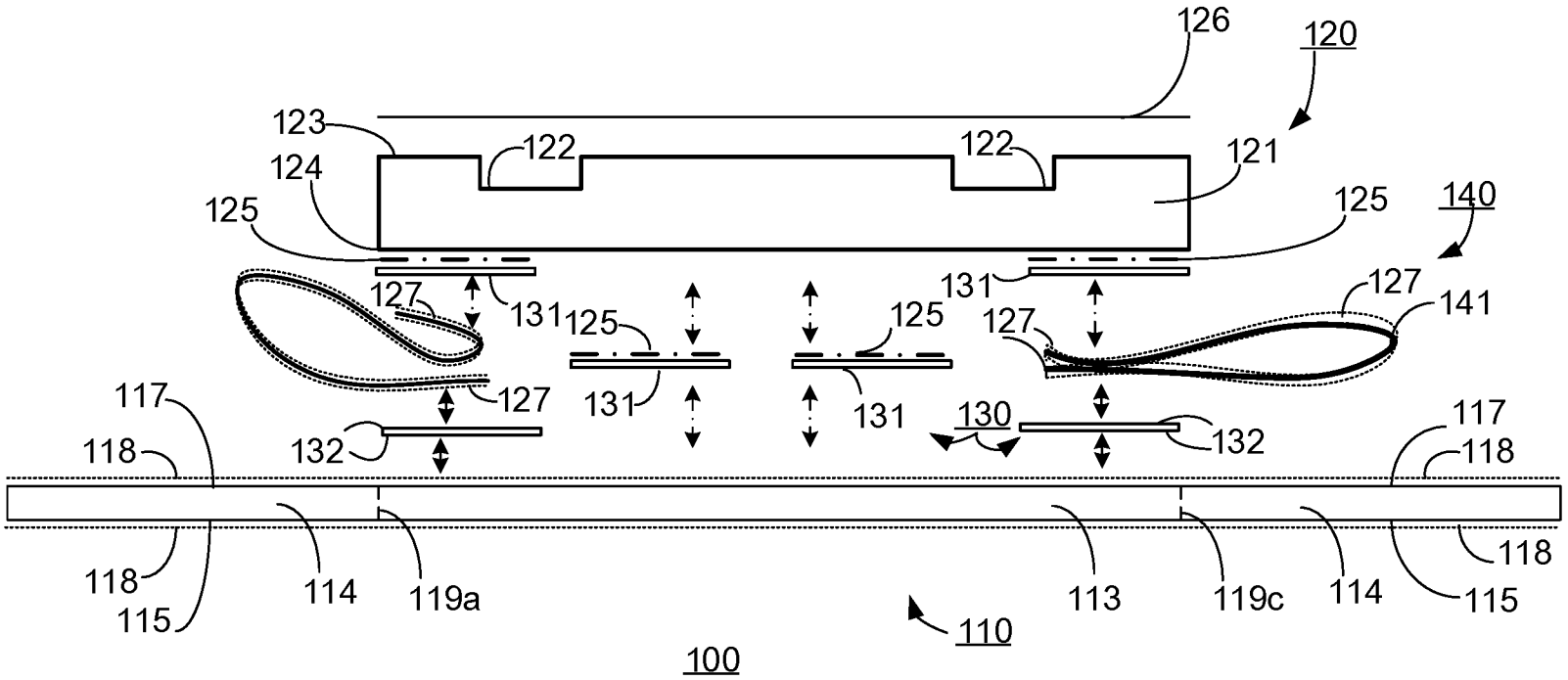
FIG. 13 illustrates a side view of a preload positioning pad assembly, system and kit according to another embodiment of the present invention.

The following sequence may be repeated for each side of the OR table 102. Referring to FIG. 9B, in a Step 2, the pre-load straps 114 of the pad assembly 110 are looped behind or otherwise around the side rail 103, as illustrated pre-load strap 114 designated strap 1 ①. The gel pad assembly 120 is separated from the pad assembly 110 exposing the hook tape along adjacent edge 119*a*, or alternatively edge 119*c*. Referring to FIG. 9C, in a Step 3, the now separated gel pad assembly 120 and the pad assembly 110 allows securing the pre-load straps 114 by the loop material 118 to the hook tape 130, as illustrated pre-load strap 114 designated strap 1 ①, as illustrated pre-load straps 114 designated straps 2 ②,3 ③, and 4 ④. As is illustrated in FIG. 9E, in a Steps 1-3 may be repeated, e.g. sequence shown in FIGS. 9A-9D, for the other side of the OR table 102, as illustrated for the pre-load straps 114 designated straps 1①, 2 ②, 3 ③, and 4 ④. As is illustrated in FIG. 9F, in a Step 5, the pad assembly 110 and gel pad assembly 120 adjacent edges 119*a* and 119*c* are closed to functionally secure the loop material 118 of pre-load straps 114 of the pad assembly 110 to the hook material 130, for example, between the separate upward facing surface (A) of double-sided hook tape 132 affixed to surface 118 on central portion 113 and the downward facing surface (B) of double-sided hook tape 132 affixed to surface 128 of the gel base 121 as illustrated in FIG. 2, or as secured in other embodiments as shown in FIGS. 13 and 15. The OR table 102 is ready for placement of clamps 104 and to secure to the patient 101 with the film 126 side UP as described herein in subsequent steps according to an embodiment of the present invention.

Figure 10A:
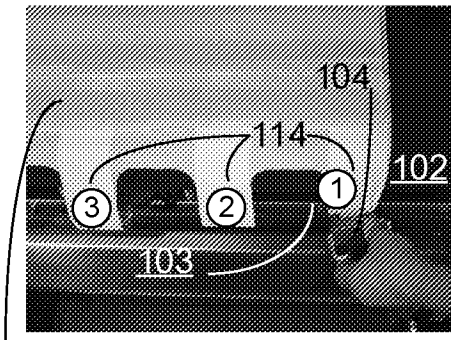
FIGS. 10A to 10E illustrate steps of securing the clamps to a pad assembly attached to the OR Table in a method according to an embodiment of the present invention.
Figure 10B:
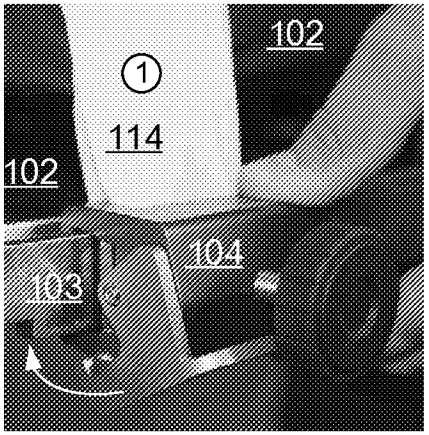
Figure 10C:
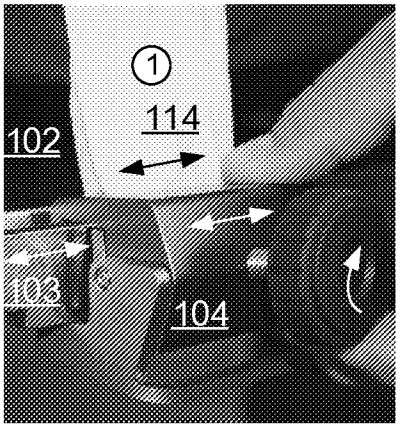
Figure 10D:
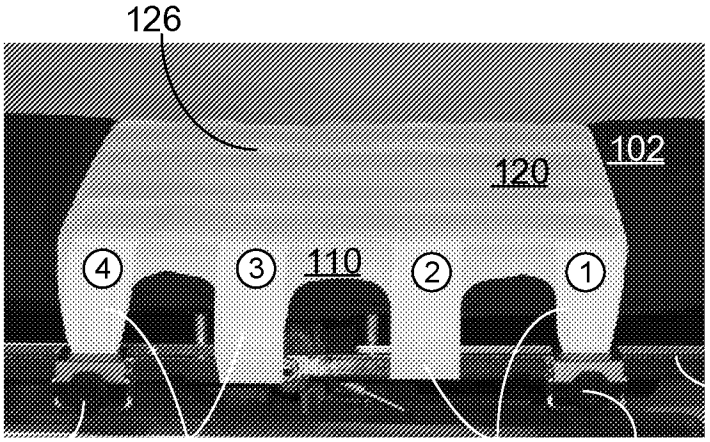
Figure 10E:
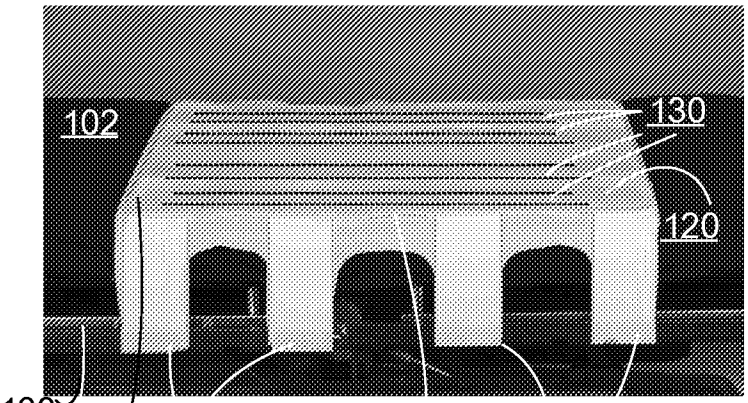

Referring to FIGS. 10A-10E, the placement of clamps 104 so as to pre-load and remove the slack from pre-load straps 114 of the pad assembly 110 secured to the OR table 102 is described according to an embodiment of the present invention. Referring to FIG. 10D, in a Step 6, a clamp 104 is fitted over the end rail 103 with the pre-load strap 114 between the clamp 104 and the end rail 103, for example, the pre-load strap 114 designated strap 1①. Referring to FIG. 10B, in a Step 7, a lever or pivot bar of the clamp 104 is rotated over the over the end rail 103 while maintaining the pre-load strap 114 between the clamp 104 and the end rail 103. For example, clamping over the proximal pre-load strap 114 designated strap 1 ① so as to seat the clamp jaws over the strap 1 ① and side rail 103. Referring to FIG. 10C, in a Step 8, the clamp 104 may be secured in a predetermined position by sliding along the end rail 103 to take out any slack, or "pre-load" tension in the strap 114 for an anticipated Trendelenburg position, while maintaining the pre-load strap 114 between the clamp 104 and the end rail 103. For example, seating the clamp 104 while holding the pivot bar over the side rail 103 and tightening the knob of clamp 104. Steps 6-8 shown in FIGS. 10B and 10C may be repeated for other clamps 104 when "pre-load" tensioning any of the pre-load strap 114 on either side rail 103 of the OR table 102 such as, for example, clamping over the proximal pre-load strap 114 designated strap 4 ① on the same side rail 103 so as to seat the clamp jaws over the strap 4 ① shown in FIG. 10D. Furthermore, the clamp 104 may be secured in a predetermined position by tightening the clamp the pre-load strap 114 between the clamp 104 and the end rail 103, for example, the pre-load strap 114 designated strap 1①. As is illustrated in FIG. 10D, in a Step 9, Steps 6-8 may be repeated for the pre-load strap 114 on the same side of the table, for example, the pre-load strap 114 designated strap 4④. As is illustrated in FIG. 10E, in a Step 10, Steps 6-9 may be repeated for the pre-load straps 114 on the other side of the OR table 102, repeating the sequence shown in FIGS. 10A-10D, for example, pre-load straps 114 designated strap 1 ① and strap 4 ④.

Figure 11A:
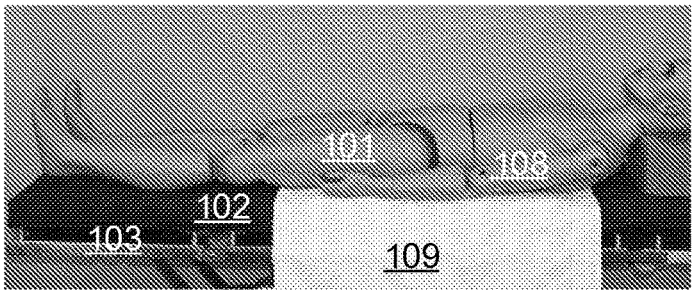
Figure 11B:
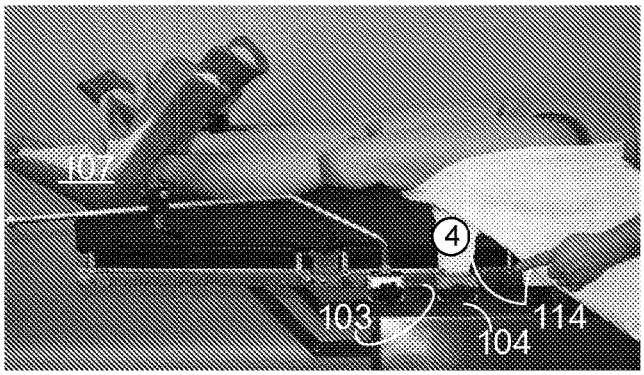

Referring to FIGS. 11A-11F, the placement and securing of the patient 101 to the pad assembly and system 100 and to the OR table 102 is described according to an embodiment of the present invention. As is illustrated in FIG. 11A, in a Step 11, the patient 101 may be transferred to the OR table 102. For example, transfer the patient 101 on the side without the clamps 104 using a draw sheet or blanket 109 or other means having the patient's torso or body placed in the proper positon on top of the pad assembly and system 100 as placed previously on the OR table 102 as illustrated in FIGS. 9A-9F and 10A-10E. As is illustrated in FIG. 11B, in a Step 12, the body holder or the boot 107 parts for the medical procedure 105 may be clamped (e.g. suitable for boot 107 attachment holder clamp 104*a*) to the rail 103 of the OR table 102.

Figure 11C:
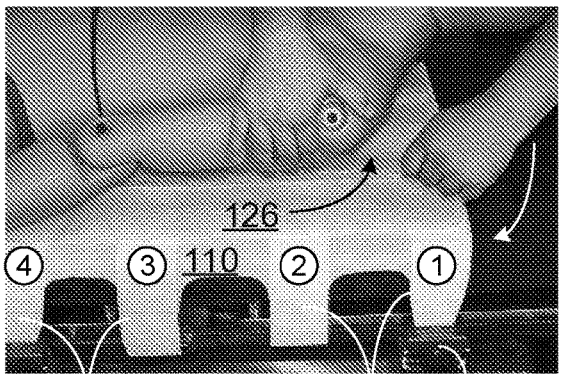

As is illustrated in FIG. 11C, in a Step 13, the film 126 of the pre-load positioning pad 100 is removed. Repeat on the other shoulder. In this manner, according to Step 13, the adhesive 125 on the upper surface 123 of the gel pad assembly 120 is adhered to a body surface of the patient 101 (e.g. the chest or back). In an alternative to Steps 11-13, the gel pad assembly 130 is separated from the pad assembly 110, the film 126 of the pre-load positioning pad 100 is removed and the surface 123 of the gel pad assembly 120 is adhered to a body surface of the patient 101 (e.g. the chest or back), and the patient 101 oriented on the table. When affixing the gel pad assembly 120 to the patient 101, the channels 122 may be oriented so as to allow fluids to flow away from underneath the patient 101 (e.g. along a spinal axis of the patient 101 so that fluids flow out when inclined such as in the Trendelenburg position, in the reverse Trendelenburg position, or both, or horizontally on the OR Table 102). Typically, the patient 101 is on the OR Table 102, whereby the gel pad assembly 120 is located in the axillary region on the patient 101, e.g. so the edge 119*a* is located near the shoulders/neck and the edge 119*c* is located near the buttocks.

Figure 11D:
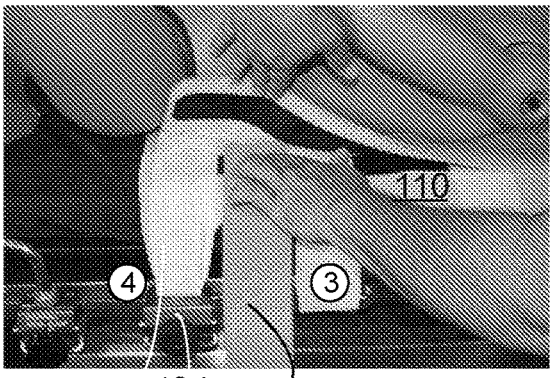
Figure 11E:
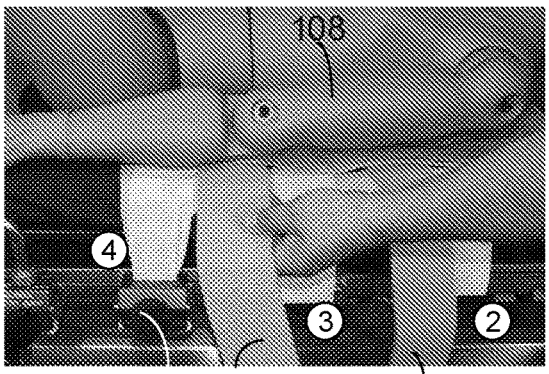
Figure 11F:
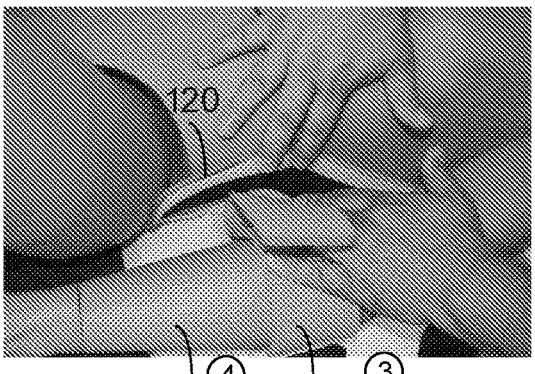

As is illustrated in FIG. 11D, in a Step 14, the loop material 127 of the limb strap 141 may affixed to the surface A of the hook material 130, such as hook tape 132, to prepare to be wrapped around an arm of the patient 101, e.g. for the forearm limb 108 of the patient 101 locating between the pre-load straps 114 designated strap 3 ③ and strap 4 ④; also for the bicep of limb 108 of the patient 101 locating between the pre-load straps 114 designated strap 1 ① and strap 2 ②. As is illustrated in FIG. 11F, in a Step 15, affixing the surface B of the hook material 130 to each the limb strap 141, e.g. for the forearm limb 108 of the patient 101 locating between the pre-load straps 114 designated strap 3 ③ and strap 4 ④; and also for the bicep of limb 108 of the patient 101 locating between the pre-load straps 114 designated strap 1 ① and strap 2 ②. As is illustrated in FIG. 11E and 11F, in a Step 16, from a plurality of the limb straps 141 are fitted on an arm, e.g. positioning the two (2) straps 141 on either side of the elbow wrapped around a bicep area and wrist area on each arm of the patient 101 as shown in FIGS. 7 and 8, to allow advantageously access for IV, vital readings, monitor leads, and other required access. As is illustrated in FIG. 11E, in a Step 17, lift the gel pad assembly 120 again to loop the limb strap 141 around the arm and to attach the loop material 127 of the limb strap 141 to the hook material 130 of the surface B positioning the two (2) straps on either side of the elbow of the patient as is shown in FIGS. 7 and 8, and 12A and 12B. In a Step 18, visual and physical safety checks should be made prior to inversion to the Trendelenburg position according to a medical procedure. For example, checking that the pre-load straps 114 are taut, that there are a minimum of two (2) TrenMax™ clamps 104 on each end rail 103 of the OR Table 102, and checking to ensure all limb straps 141 are secure. Moreover, the knobs of clams 104 should be tightened and in a locked position. As is shown in FIGS. 7 and 8, and 12A and 12B, in a Step 19, at this stage the operator may proceed with inversion to the Trendelenburg position according to a medical procedure 105 to positioning the patient 103 in Trendelenburg, for example, with the limbs 108 in the boot 107 for a knee surgical operation.

In the foregoing Steps 14-17, and as reflected in an embodiment consistent with FIGS. 14-15, the hook surface 142 is fastened to the loop material 128 of the gel pad assembly 120 at a location near or under patient, whereby it is to be appreciated that the location near or under patient 101 is infinitely variable and determined by the size, weight and/or other dimension of the patient as well as other factors such as the intended medical procedure 105, as shown in FIGS. 7-8. Accordingly, the pre-load positioning pad assembly and kit 100 of the present invention advantageously is infinitely variable and may be utilized any type of patient (or for animals) in the intended medical procedure 105. Moreover, patient health and comfort is increased suing the gel pad assembly and adjustable limb straps allowing advantageously for comfort, intravenous placement and spreading of forces, irrigation and drainage of fluids, preventing tissue injury, ischemia, neurological impairment, and eliminating pressure on brachial plexus. In this manner, the pre-load positioning pad apparatus, assembly, system, method and/or kit 100 advantageously eliminates restriction to the shoulders, neck or head that may cause injury from a potential impingement to the brachial plexus.

According to an alternative embodiment of the method 100, the pre-load positioning pad 100 may be disassembled to expose the pad assembly 110, gel pad assembly 120, hook tab and retaining assembly 140 for the placement and securing of the patient 101 to the pad assembly and system 100 and to the OR table. In Steps 11-14, the hook tape 130 may be arranged, secured and/or fastened to the loop material 128 on the gel pad assembly 120 advantageously varying for any type of patient (or for animals) in the intended medical procedure 105. The hook tape 130 may be oriented adjacent channels 122. The base 111 of the pad assembly 110 is secured to the hook tape 130 and the patient can lie down with the preload positioning pad 100 finally disposed underneath the patient 101. Referring to FIG. 2, the hook tape 130 operatively couples, for example, to both the loop fabric 118 of the base 111 and the loop material 128 of the gel pad assembly 120 according to this construction.

In an alternative embodiment illustrated in FIGS. 14-15, the gel base 121 is configured with an upper surface 123 and a lower surface 124 formed with an adhesive 125. The adhesive 125 disposed on the upper surface 123 is utilized to adhere the upper surface 123 to the patient 101. The adhesive 125 on the upper surface 123 may be shielded prior to use by a film 126 made removable by peeling away or the like as shown in FIG. 9-12. Similarly, the adhesive 125 of the lower surface 124 is secured to loop material 127. The loop material 127 may be attached to smooth material 116 of a construction similar to the base 111 may constructed from the materials similar to the base 111 (e.g. with loop fabric 118 on one side and plastic smooth material 116 on the other side). The smooth material 116 secures to the adhesive 125 of the lower surface 124 so as to orient the loop material 127 on a surface outwardly facing surface opposite the upper surface 123 now adhered to the patient 101 (e.g. with the film 126 removed).

Referring to FIG. 16, a preload clamp 160 utilized in the positioning pad assembly, system, method and kit according to another embodiment of the present invention. It is appreciated that other suitable clamps 104 may be utilized. A TrenMax clamp 160 configured to clamp a pre-load strap 114 to a side rail 103 of an operating table 102 is shown in FIG. 16. The TrenMax clamp 160 comprises a clamp body 162 having a cavity with a plate 164 for engaging the side rail 103. The plate generally is operably connected to the knob 168, whereby tightening the knob pushes plate 164 against the pre-load strap 114 and side rail 103 so as to secure in position on the OR table 102, Revering the knob 168 loosens plate 164 and frees the pre-load strap 114 and side rail 103 for positioning, and re-positioning, as needed. The clamp body 162 may be formed from suitable surgical metals such as aluminum, stainless steel or other surgical metal alloys that are durable, strong and may be sterilized. A TrenMax clamp 160 is available from Innovative Medical Products, Inc., Plainville, Conn. as product TrenMax™ clamp.

While certain configurations of structures have been illustrated for the purposes of presenting the basic structures of the present invention, one of ordinary skill in the art will appreciate that other variations are possible which would still fall within the scope of the appended claims. For example, the method, apparatus, system and kit 100 is infinitely variable and may be utilized for animals in an intended medical procedure. Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A pad assembly configured to support a body of a patient during a medical procedure, said pad assembly comprising:

a base formed in a predetermined shape, said base having at least a top surface formed with loop fabric, said predetermined shape comprised of a center portion and a plurality of pre-load straps extending outwardly from said center portion;

a gel pad assembly comprising a gel base portion with an upper surface having one or more channels adapted to direct fluid away from the body of the patient and a lower surface operably connected to a sheet of loop fabric;

at least one section of hook fabric and/or hook tape, disposed between said base and said gel pad assembly, operably connected to said sheet of loop fabric of said gel pad assembly and to said top surface of said base; and a plurality of limb straps each formed from a strip of material having a first end and a second end, and a hook fabric portion affixed to said first and second ends, aligned by folding said strip of material, said hook fabric portion of each of said plurality of limb straps being operably connected to said loop fabric of said top surface of said base and to said sheet of loop fabric of said gel pad assembly wherein, in a spaced apart relationship on a limb, at least one limb strap of said plurality of limb straps is configured to hold the forearm of said limb, and at least one other limb strap of said plurality of limb straps is configured to hold the upper arm of said limb.

2. The pad assembly according to claim 1 wherein said base is formed from a suitable material from the group of plastics, medical grade thermo-plastics, adhesive gels, and medical grade polymer composite adhesive gels that are not silicon based having suitable strength, an abrasive structure for damping and a polymer web structure that resists stretching.

3. The pad assembly according to claim 1 wherein said predetermined shape of said base having a length adapted to extend from at least a thigh portion to at least a shoulder portion of the patient so as to support the torso being placed on said gel pad assembly.

4. The pad assembly according to claim 1 wherein said gel pad assembly is configured to hold a patient in a desired position on said gel pad assembly against gravitational forces upon an operating room table being tilted at an angle in the medical procedure.

5. The pad assembly according to claim 1 wherein said gel pad assembly is configured to distribute pressure forces of the body in contact with said gel pad assembly during the medical procedure.

6. The pad assembly according to claim 1 wherein each of said one or more channels is configured to direct flow thereby allowing the gel pad assembly to perform the function of irrigation, drainage, and/or otherwise removing fluid adjacent the body during the medical procedure.

7. The pad assembly according to claim 1 wherein said hook fabric portion is releasably connected to said lower surface of said gel base portion thereby adapted to allow repositioning of said limb.

8. The pad assembly according to claim 1 wherein said gel base portion is formed from suitable non-latex based gel material.

9. The pad assembly according to claim 1 further comprising one or more elongated strips of hook fabric operably connected to said lower surface of said gel base portion and/or to said base.

10. The pad assembly according to claim 1 wherein each of said plurality of limb straps having said first end having said hook fabric and said second end being affixed to said lower surface of said gel base portion or to said base, said being affixed to selected from the group consisting of a staple, stitch, glue, adhesive, or other fastener, whereby said hook fabric portion is releasably connected to said gel base portion and/or base portion thereby adpated to allow repositioning of said limb.

* * * * *